United States Patent [19]

Dorer et al.

[11] Patent Number: 4,780,111

[45] Date of Patent: Oct. 25, 1988

[54] FUEL COMPOSITIONS

[75] Inventors: Casper J. Dorer, Lyndhurst; Reed H. Walsh, Mentor, both of Ohio

[73] Assignee: The Lubrizol Corporation, Wickliffe, Ohio

[21] Appl. No.: 796,360

[22] Filed: Nov. 8, 1985

[51] Int. Cl.[4] ..... C10L 1/22; C10L 1/18

[52] U.S. Cl. ..... 44/71; 44/58; 44/63; 44/66; 44/73

[58] Field of Search ..... 44/63, 66, 71, 58

[56] References Cited

U.S. PATENT DOCUMENTS

| | | | |
|---|---|---|---|
| 2,809,160 | 10/1957 | Stewart | 252/33.4 |
| 2,900,339 | 8/1959 | Lowe | 252/33.4 |
| 3,185,704 | 5/1965 | Kahn et al. | 44/63 |
| 3,216,936 | 11/1965 | LeSuer | 252/32.7 |
| 3,240,575 | 3/1966 | Miller et al. | 44/66 |
| 3,287,271 | 11/1966 | Stuart et al. | 252/51.5 A |
| 3,639,242 | 2/1972 | LeSuer | 252/56 |
| 3,692,681 | 9/1972 | Liston | 252/51.5 |
| 3,708,522 | 1/1973 | LeSuer | 260/485 |
| 4,148,605 | 4/1979 | Andress, Jr. | 44/63 |
| 4,203,855 | 5/1980 | Steckel | 252/42.7 |
| 4,234,435 | 11/1980 | Meinhardt et al. | 252/51.5 |
| 4,460,381 | 7/1984 | Karol et al. | 44/63 |
| 4,501,597 | 2/1985 | Karol et al. | 44/63 |
| 4,509,955 | 4/1985 | Hayashi | 44/62 |

FOREIGN PATENT DOCUMENTS

| | | | |
|---|---|---|---|
| 1162436 | of 0000 | United Kingdom | 27/08 |

*Primary Examiner*—William R. Dixon, Jr.
*Assistant Examiner*—Ellen McAvoy
*Attorney, Agent, or Firm*—James L. Cordek; Joseph P. Fischer; Robert A. Franks

[57] ABSTRACT

Fuel compositions for internal combustion engines, and more particularly, fuel compositions for use in fuel-injected internal combustion engines are described. The fuel compositions comprise a major amount of a liquid hydrocarbon fuel and a minor, property-improving amount of a hydrocarbon-soluble dispersant prepared generally by the post-treatment of a nitrogen-containing composition with mono- and polycarboxylic acids which may be aliphatic or aromatic carboxylic acids although aromatic polycarboxylic acids are preferred. The nitrogen-containing compositions which are post-treated in accordance with the present invention are obtained by reacting an acylating agent with alkylene polyamines or alkanol amines. When fuel compositions of the present invention are utilized in internal combustion engines, and in particular, fuel-injected internal combustion engines, the amount of solid deposits of the various parts of the internal combustion engines are reduced. In particular, the use of such fuels prevents or reduces intake system deposits and injector nozzle deposits. Accordingly, methods for reducing or preventing the build-up of deposits in internal combustion engines also are described.

22 Claims, No Drawings

FUEL COMPOSITIONS

BACKGROUND OF THE INVENTION

This invention relates to fuel compositions for internal combustion engines, and more particularly to fuel compositions containing ashless dispersants capable of reducing and/or preventing the deposit of solid materials in internal combustion engines and in particular in the intake systems and fuel port injector nozzles.

The prior art discloses many ashless dispersants useful as additives in fuels and lubricant compositions. A large number of such ashless dispersants are derivatives of high molecular weight carboxylic acid acylating agents. Typically, the acylating agents are prepared by reacting an olefin (e.g., a polyalkene such as polybutene) or a derivative thereof, containing for example at least about 10 aliphatic carbon atoms or generally at least 30 to 50 aliphatic carbon atoms, with an unsaturated carboxylic acid or derivative thereof such as acrylic acid, methylacrylate, maleic acid, fumaric acid and maleic anhydride. Dispersants are prepared from the high molecular weight carboxylic acid acylating agents by reaction with, for example, amines characterized by the presence within their structure of at least one N-H group, alcohols, reactive metal or reactive metal compounds, and combinations of the above. The prior art relative to the preparation of such carboxylic acid derivatives is summarized in U.S. Pat. No. 4,234,435.

It also has been suggested that the carboxylic acid derivative compositions such as those described above can be post-treated with various reagents to modify and improve the properties of the compositions. Acylated nitrogen compositions prepared by reacting the acylating reagents described above with an amine can be post-treated, for example, by contacting the acylated nitrogen compositions thus formed with one or more post-treating reagents selected from the group consisting of boron oxide, boron oxide hydrate, boron halides, boron acids, esters of boron acid, carbon disulfide, sulfur, sulfur chlorides, alkenyl cyanides, carboxylic acid acylating agents, aldehydes, ketones, phosphoric acid, epoxides, etc. Lists of the prior art relating to post-treatment of carboxylic ester and amine dispersants with reagents such as those described above are contained in a variety of patents such as U.S. Pat. No. 4,203,855 (Col. 19, lines 16–34) and U.S. Pat. No. 4,234,435 (Col. 42, lines 33–46).

The use of isophthalic and terephthalic acids as corrosion-inibitors is described in U.S. Pat. No. 2,809,160. The corrosion-inhibitors are used in combination with detergent additives.

The preparation of lubricating oils containing ashless dispersants obtained by reaction of aliphatic and aromatic polycarboxylic acids with acylated amines have been described previously. For example, U.S. Pat. No. 4,234,435 describes lubricating oils containing carboxylic acid derivative compositions prepared by post-treating acylated amines with a variety of compositions including carboxylic acid acylating agents such as terephthalic acid and maleic acid. U.S. Pat. No. 3,287,271 and French Pat. No. 1,367,939 describe detergent-corrosion inhibitors for lubricating oils prepared by combining a polyamine with a high molecular weight succinic anhydride and thereafter contacting the resulting product with an aromatic dicarboxylic acid of from 8 to 14 carbon atoms wherein the carboxyl groups are bonded to annular carbon atoms separated by at least one annular carbon atom. Illustrative of such aromatic dicarboxylic acids are isophthalic acid, terephthalic acid and various derivatives thereof. Lubricating compositions containing amine salts of a phthalic acid are described in U.S. Pat. No. 2,900,339. The amine salts are thermally unstable salts of the phthalic acid and a basic tertiary amine. U.S. Pat. No. 3,692,681 describes dispersions of phthalic acid in hydrocarbon media containing highly hindered acylated alkylene polyamines. The polyamines are prepared by reaction of an alkenyl succinic anhydride with an alkylene polyamine such as ethylene polyamine or propylene polyamine. The terephthalic acid or its derivative is dissolved in an auxiliary solvent such as a tertiary alcohol or DMSO, and a terephthalic acid solution is combined with a hydrocarbon solution containing the hindered acylated amine address detergent. The auxiliary solvent then is removed.

U.S. Pat. No. 3,216,936 describes lubricant additives which are compositions derived from the acylation of alkylene polyamines. More specifically, the compositions are obtained by reaction of an alkylene amine with an acidic mixture consisting of a hydrocarbon-substituted succinic acid having at least about 50 aliphatic carbon atoms in the hydrocarbon group and an aliphatic monocarboxylic acid, and thereafter removing the water formed by the reaction. The ratio of equivalents of said succinic acid to the mono-carboxylic acid in the acidic mixture is from about 1:0.1 to about 1:1. The aliphatic mono-carboxylic acids contemplated for use include saturated and unsaturated acids such as acetic acid, dodecanoic acid, oleic acid, naphthenic acid, formic acid, etc. Acids having 12 or more aliphatic carbon atoms, particularly stearic acid and oleic acid, are especially useful. The products described in the '936 patent also are useful in oil-fuel mixtures for two-cycle internal combustion engines.

British Pat. No. 1,162,436 describes ashless dispersants useful in lubricating compositions and fuels. The compositions are prepared by reacting certain specified alkenyl substituted succinimides or succinic amides with a hydrocarbon-substituted succinic acid or anhydride. The arithmatic mean of the chain lengths of the two hydrocarbon substituents is greater than 50 carbon atoms. Formamides of monoalkenyl succinimides are described in U.S. Pat. No. 3,185,704. The formamides are reported to be useful as additives in lubricating oils and fuels.

U.S. Pat. Nos. 3,639,242 and 3,708,522 describe compositions prepared by post-treating mono- and polycarboxylic acid esters with mono- or polycarboxylic acid acylating agents. The compositions thus obtained are reported to be useful as dispersants in lubricants and fuels.

SUMMARY OF THE INVENTION

Fuel compositions for internal combustion engines, and more particularly, fuel compositions for use in fuel-injected internal combustion engines are described. The fuel compositions comprise a major amount of a liquid hydrocarbon fuel and a minor, property-improving amount of a hydrocarbon-soluble dispersant prepared generally by the post-treatment of a nitrogen-containing composition with mono- and polycarboxylic acids which may be aliphatic or aromatic carboxylic acids although aromatic polycarboxylic acids are preferred.

The nitrogen-containing compositions which are post-treated in accordance with the present invention are obtained by reacting an acylating agent with alkylene polyamines or alkanol amines. When fuel compositions of the present invention are utilized in internal combustion engines, and in particular, fuel-injected internal combustion engines, the amount of solid deposits of the various parts of the internal combustion engines are reduced. In particular, the use of such fuels prevents or reduces intake system deposits and injector nozzle deposits. Accordingly, methods for reducing or preventing the build-up of deposits in internal combustion engines also are described.

DESCRIPTION OF THE PREFERRED EMBODIMENTS

The fuels which are contemplated for use in the fuel compositions of the present invention are normally liquid hydrocarbon fuels in the gasoline boiling range, including hydrocarbon base fuels. The term "petroleum distillate fuel" also is used to describe the fuels which can be utilized in the fuel compositions of the present invention and which have the above characteristic boiling points. The term, however, is not intended to be restricted to straight-run distillate fractions. The distillate fuel can be straight-run distillate fuel, catalytically or thermally cracked (including hydro cracked) distillate fuel, or a mixture of straight-run distillate fuel, naphthas and the like with cracked distillate stocks. The hydrocarbon fuels also can contain non-hydrocarbonaceous materials such as alcohols, ethers, organo-nitro compounds, etc. Such materials can be mixed with the hydrocarbon fuel in varying amounts of up to about 10–20% or more. For example, alcohols such as methanol, ethanol, propanol and butanol, and mixtures of such alcohols are included in commercial fuels in amounts of up to about 10%. Other examples of materials which can be mixed with the fuels include diethyl ether, methyl ethyl ether, methyl tertiary butyl ether, nitromethane. Also included within the scope of the invention are liquid fuels derived from vegetable or mineral sources such as corn, alfalfa, shale and coal. Also, the base fuels used in the formation of the fuel compositions of the present invention can be treated in accordance with well-known commercial methods, such as acid or caustic treatment, hydrogenation, solvent refining, clay treatment, etc.

Gasolines are supplied in a number of different grades depending on the type of service for which they are intended. The gasolines utilized in the present invention include those designed as motor and aviation gasolines. Motor gasolines include those defined by ASTM specification D-430-73 and are composed of a mixture of various types of hydrocarbons including aromatics, olefins, paraffins, isoparaffins, naphthenes and occasionally diolefins. Motor gasolines normally have a boiling range within the limits of about 70° F. to 450° F. while aviation gasolines have narrower boiling ranges, usually within the limits of about 100° F.–330° F.

The fuel compositions of the present invention contain a minor, property improving amount of at least one hydrocarbon-soluble dispersant as described hereinafter. The presence of such dispersants in the fuel compositions of the present invention provides the fuel composition with a desirable ability to prevent or minimize undesirable engine deposits, especially in the intake area and fuel injector nozzles.

In one embodiment (hereinafter referred to as the "first embodiment"), the fuel compositions of the present invention are utilized in internal combustion engines other than two-cycle engines, and the dispersant utilized in such fuel compositions are hydrocarbon-soluble dispersants prepared by reacting (A-1) at least one first acylating agent selected from mono- and polycarboxylic acids or such acid-producing compounds with (A-2) at least one alkylene polyamine and (B) at least one second acylating agent selected from aliphatic monocarboxylic acids having at least 2 carbon atoms and aromatic mono- and polycarboxylic acids, or such acid-producing compounds, the total number of carbon atoms in the first and second acylating agents (A-1) and (B) being sufficient to render the dispersant hydrocarbon-soluble.

In a second embodiment (hereinafter referred to as the "second embodiment"), the fuel compositions can be utilized in any internal combustion engine, and the dispersants utilized in such fuel composition comprise at least one hydrocarbon-soluble dispersant prepared by reacting (A-1) at least one first acylating agent selected from mono- and polycarboxylic acids or such acid-producing compounds with (A-2) at least one alkylene polyamine and (B) at least one second acylating agent selected from aromatic mono- and polycarboxylic acids having at least 7 carbon atoms, or such acid-producing compounds, the total number of carbon atoms in the first and second acylating agents (A-1) and (B) being sufficient to render the dispersant hydrocarbon-soluble.

In a third embodiment (hereinafter referred to as the "third embodiment", the dispersants utilized in the fuel compositions are based upon alkanol amines and are prepared by reacting (A-1) at least one first acylating agent selected from mono- and polycarboxylic acids or such acid-producing compounds with (A-2) at least one alkanol amine and (B) at least one second acylating agent selected from mono- and polycarboxylic acids, or such acid-producing compounds, the total number of carbon atoms in the first and second acylating agents (A-1) and (B) being sufficient to render the dispersant hydrocarbon-soluble.

As can be seen from the above, the dispersants utilized in the various embodiments differ in the particular combinations of reactants (A-1), (A-2) and (B). For example, the first and second embodiments utilize polyamines as reactant (A-2) whereas the third embodiment utilizes alkanol amines as reactant (A-2). Also, in the first embodiment, the second acylating agent may be an aliphatic monocarboxylic acid or an aromatic mono- or polycarboxylic acid, anhydride, acyl halide, etc., whereas in the second embodiment, the second acylating agent is an aromatic mono- or polycarboxylic acid, anhydride or halide thereof.

In all three embodiments, the dispersants preferably are prepared by initially reacting the first acylating agent (A-1) with (A-2) the polyamine or alkanol amine to form a nitrogen-containing composition (A), and thereafter reacting said nitrogen-containing composition with (B) the second acylating agent as defined. When this preferred method is utilized in the first, second or third embodiments defined above, the embodiments are referred to in this specification as the "first preferred embodiment", the "second preferred embodiment", and the "third preferred embodiment", respectively.

An alternative method of preparing the dispersants involves preparing a mixture of the first and second acylating agents, and reacting the mixture with the polyamine or alkanol amine. Another alternative method involves initially reacting the polyamine with the second acylating agent, and thereafter with the first acylating agent.

REACTANT A-1

The first carboxylic acylating agent (A-1) may be at least one aliphatic or aromatic mono- or polycarboxylic acid or such acid-producing compounds. Throughout this specification and claims, any reference to carboxylic acids as acylating agents is intended to include the acid-producing derivatives such as anhydrides, esters, acyl halides, and mixtures thereof unless otherwise specifically stated.

The aliphatic monocarboxylic acids contemplated for use in the process of this invention include saturated and unsaturated acids. Examples of such useful acids are formic acid, acetic acid, chloroacetic acid, butanoic acid, cyclohexanoic, dodecanoic acid palmitic acid, decanoic acid, oleic acid, stearic acid, linoleic acid, linolenic acid, naphthenic acid, chlorostearic acid, tall oil acid, etc. Acids having 12 or more aliphatic carbon atoms, particularly stearic acid and oleic acid, are especially useful.

The aliphatic monocarboxylic acids useful in this invention may be isoaliphatic acids, i.e., acids having one or more lower acyclic pendant alkyl groups. The isoaliphatic acids result in products which are more readily soluble in hydrocarbon fuels at relatively high concentrations and more readily miscible with other additives in the fuel. Such acids often contain a principal chain having from 14 to 20 saturated, aliphatic carbon atoms and at least one but no more than about four pendant acyclic alkyl groups. The principal chain of the acid is exemplified by groups derived from tetradecane, pentadecane, hexadecane, heptadecane, octadecane, and eicosane. The pendant group is preferably a lower alkyl radical such as methyl, ethyl, n-propyl, isopropyl, n-butyl, isobutyl, tert-butyl, n-hexyl, or other radical having less than about 6 carbon atoms. The pendant group may also be a polar-substituted alkyl radical such as chloromethyl, bromobutyl, methoxyethyl, or the like, but it preferably contains no more than one polar substituent per radical. Specific examples of such acids are isoaliphatic acids such as 10-methyl-tetradecanoic acid, 11-methyl-pentadecanoic acid, 3-ethylhexadecanoic acid, 15-methyl-heptadecanoic acid, 16-methyl-heptadecanoic acid, 6-methyl-octadecanoic acid, 8-methyl-octadecanoic acid, 10-methyl-octadecanoic acid, 14-methyl-octadecanoic acid, 16-methyl-octadecanoic acid, 15-ethyl-heptadecanoic acid, 3-chloromethyl-nonadecanoic acid, 7,8,9,10-tetramethyl-octadecanoic acid, and 2,9,10-trimethyl-octadecanoic acid.

An especially useful class of isoaliphatic acids includes mixtures of branch-chain acids prepared by the isomerization of commercial fatty acids. A particularly useful method comprises the isomerization of an unsaturated fatty acid having from 16 to 20 carbon atoms, by heating it at a temperature above about 250° C. and at a pressure between about 200 and 700 psi (pounds per square inch), distilling the crude isomerized acid, and hydrogenating the distillate to produce a substantially saturated isomerized acid. The isomerization is promoted by a catalyst such as mineral clay, diatomaceous earth, aluminum chloride, zinc chloride, ferric chloride, or some other Friedel-Crafts catalyst. The concentration of the catalyst may be as low as 0.01%, but more often from 0.1% to 3% by weight of the isomerization mixture. Water also promotes the isomerization and a small amount, from 0.1% to 5% by weight, of water may thus be advantageously added to the isomerization mixture.

The unsaturated fatty acids from which the isoaliphatic acids may be derived include, in addition to oleic acid mentioned above, linoleic acid, linolenic acid, or commercial fatty acid mixtures such as tall oil acids containing a substantial proportion of unsaturated fatty acids.

The aliphatic polycarboxylic acids useful as acylating agent (A-1) may be low molecular weight polycarboxylic acids as well as higher molecular weight polycarboxylic acids. Examples of low molecular weight acylating agents include dicarboxylic acids and derivatives such as maleic acid, maleic anhydride, chloromaleic anhydride, malonic acid, succinic acid, succinic anhydride, glutaric acid, glutaric anhydride, adipic acid, pimelic acid, azelaic acid, sebacic acid, glutaconic acid, citraconic acid, itaconic acid, allyl succinic acid, cetyl malonic acid, tetrapropylene-substituted succinic anhydride, etc.

Generally, the first acylating agent (A-1) will be at least one substituted mono- and polycarboxylic acid (or anhydride, etc.). The number of carbon atoms present in the mono- or polycarboxylic acid acylating agents is important in contributing to the desired hydrocarbon-solubility of the dispersant. As mentioned above, it is important that the sum of the carbon atoms in the first and second acylating agents, (A-1) and (B) respectively, be sufficient to render the dispersant hydrocarbon-soluble. Generally, if the first acylating agent contains a large number of carbon atoms, the second acylating agent may be selected containing fewer carbon atoms. Conversely, if the second acylating agent contains a large number of carbon atoms, the first acylating agent can be selected containing fewer carbon atoms. Usually, in order to provide the desired hydrocarbon solubility, the sum of the carbon atoms in the first and second acylating agents will total at least 10 carbon atoms, and more generally, will be at least 30 carbon atoms.

The acylating agent may contain polar substituents provided that the polar substituents are not present in portions sufficiently large to alter significantly the hydrocarbon character of the acylating agent. Typical suitable polar substituents include halo, such as chloro and bromo, oxo, oxy, formyl, sulfenyl, sulfinyl, thio, nitro, etc. Such polar substituents, if present, preferably do not exceed 10% by weight of the total weight of the hydrocarbon portion of the acylating agent, exclusive of the carboxyl groups.

Carboxylic acid acylating agents suitable for use as reactant (A-1) are well known in the art and have been described in detail, for example, in U.S. Pat. Nos. 3,087,936; 3,163,603; 3,172,892; 3,219,666; 3,272,746; 3,306,907; 3,346,354; and 4,234,435. In the interest of brevity, these patents are incorporated herein for their disclosure of suitable mono- and polycarboxylic acid acylating agents which can be used as starting materials (A-1) in the present invention.

As disclosed in the foregoing patents, there are several processes for preparing the acids. Generally, the process involves the reaction of (1) an ethylenically unsaturated carboxylic acid, acid halide, or anhydride with (2) an ethylenically unsaturated hydrocarbon containing at least about 10 aliphatic carbon atoms or a chlorinated hydrocarbon containing at least about 10 aliphatic carbon atoms at a temperature within the range of about 100°-300° C. The chlorinated hydrocarbon or ethylenically unsaturated hydrocarbon reactant can, of course, contain polar substituents, oil-solubilizing pendant groups, and be unsaturated within the general limitations explained hereinabove. It is these hydrocarbon reactants which provides most of the aliphatic carbon atoms present in the acyl moiety of the final products.

When preparing the carboxylic acid acylating agent according to one of these two processes, the carboxylic acid reactant usually corresponds to the formula $R_o$—(-COOH)n, where $R_o$ is characterized by the presence of at least one ethylenically unsaturated carbon-to-carbon covalent bond and n is an integer from 1 to 6 and preferably 1 or 2. The acidic reactant can also be the corresponding carboxylic acid halide, anhydride, ester, or other equivalent acylating agent and mixtures of one or more of these. Ordinarily, the total number of carbon atoms in the acidic reactant will not exceed 10 and generally will not exceed 6. Preferably the acidic reactant will have at least one ethylenic linkage in an alpha, beta-position with respect to at least one carboxyl function. Exemplary acidic reactants are acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, and the like. Due to considerations of economy and availability, these acid reactants usually employed are acrylic acid, methacrylic acid, maleic acid, and maleic anhydride.

As is apparent from the foregoing discussion, the carboxylic acid acylating agents may contain cyclic and/or aromatic groups. However, the acids are essentially aliphatic in nature and in most instances, the preferred acid acylating agents are aliphatic mono- and polycarboxylic acids, anhydrides, and halides.

The substantially saturated aliphatic hydrocarbon-substituted succinic acid and anhydrides are especially preferred as acylating agents (A-1) used as starting materials in the present invention. These succinic acid acylating agents are readily prepared by reacting maleic anhydride with a high molecular weight olefin or a chlorinated hydrocarbon such as a chlorinated polyolefin. The reaction involves merely heating the two reactants at a temperature of about 100°-300° C., preferably, 100°-200° C. The product from such a reaction is a substituted succinic anhydride where the substituent is derived from the olefin or chlorinated hydrocarbon as described in the above-cited patents. The product may be hydrogenated to remove all or a portion of any ethylenically unsaturated covalent linkages by standard hydrogenation procedures, if desired. The substituted succinic anhydrides may be hydrolyzed by treatment with water or steam to the corresponding acid and either the anhydride or the acid may be converted to the corresponding acid halide or ester by reacting with phosphorus halide, phenols, or alcohols.

The ethylenically unsaturated hydrocarbon reactant and the chlorinated hydrocarbon reactant used in the preparation of the acylating agents are principally the high molecular weight, substantially saturated petroleum fractions and substantially saturated olefin polymers and the corresponding chlorinated products. The polymers and chlorinated polymers derived from mono-olefins having from 2 to about 30 carbon atoms are preferred. The especially useful polymers are the polymers of 1-mono-olefins such as ethylene, propene, 1-butene, isobutene, 1-hexene, 1-octane, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

The interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with chloroprene, isobutene with p-methyl-styrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of hydrocarbon solubility, the interpolymers contemplated for use in preparing the acylating agents of this invention should be substantially aliphatic and substantially saturated, that is, they should contain at least about 80% and preferably about 95%, on a weight basis, of units derived from aliphatic mono-olefins. Preferably, they will contain no more than about 5% olefinic linkages based on the total number of the carbon-to-carbon covalent linkages present.

The chlorinated hydrocarbons and ethylenically unsaturated hydrocarbons used in the preparation of the acylating agents can have molecular weight of up to about 100,000 or even higher. The preferred reactants are the above-described polyolefins and chlorinated polyolefins containing an average of at least 10 carbon atoms, preferably at least 30 or 50 carbon atoms.

The acylating agents may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polyhydric alcohol with potassium permanganate, nitric acid, or a similar oxidizing agent. Another method for preparing such polycarboxylic acids involves the reaction of an olefin or a polar-substituted hydrocarbon such as a chlorpolyisobutene with an unsaturated polycarboxylic acid such as 2-pentene-1,3,5-tricarboxylic acid prepared by dehydration of citric acid.

Monocarboxylic acid acylating agents may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

Monocarboxylic and polycarboxylic acid acylating agents can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281.

The monocarboxyic and polycarboxylic acid anhydrides are obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid radicals separated by no more than three carbon atoms such as substituted succinic or glutaric acid, whereas linear anhydrides are obtained from polycarboxylic acids having the acid radicals separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Although it is preferred that the first acylating agent is an aliphatic mono- or polycarboxylic acid, and more preferably a dicarboxylic acid, the carboxylic acylating agent (A-1) also may be an aromatic mono- or polycarboxylic acid or acid-producing compound. The aromatic acids are principally mono- and dicarboxy-substituted benzene, naphthalene, anthracene, phenanthrene or like aromatic hydrocarbons. They include also the alkyl-substituted derivatives, and the alkyl groups may contain up to about 30 carbon atoms. The aromatic acid may also contain other substituents such as halo, hydroxy, lower alkoxy, etc. Specific examples of aromatic mono- and polycarboxylic acids and acid-producing compounds useful as acylating agent (A-1) include benzoic acid, m-toluic acid, salicyclic acid, phthalic acid, isophthalic acid, terephthalic acid, 4-propoxy-benzoic acid, 4-methyl-benzene-1,3-dicarboxylic acid, naphthalene-1,4-dicarboxylic acid, anthracene dicarboxylic acid, 3-dodecyl-benzene-1,4-dicarboxylic acid, 2,5-dibutylbenzene-1,4-dicarboxylic acid, etc. The anhydrides of these dicarboxylic acids also are useful as the first carboxylic acylating agent (A-1).

REACTANT A-2

The alkylene polyamines useful as reactant (A-2) may be generally characterized by the formula

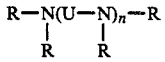

wherein U is an alkylene group of from about 1 to about 18 carbon atoms, each R is independently a hydrogen atom, an hydrocarbyl group, or a hydroxy-substituted hydrocarbyl group containing from one up to about 700 carbon atoms, more generally up to about 30 carbon atoms, with the proviso that at least one R group is a hydrogen atom, and n is 1 to about 10.

Preferably, n is an integer less than about 6, and the alkylene group (U) is preferably a lower alkylene group such as ethylene, propylene, trimethylene, tetramethylene, etc. Specific examples of alkylene polyamines represented by the above formula include ethylene diamine, diethylene triamine, triethylene tetramine, tetraethylene pentamine, trimethylene diamine, propylene diamine, tetramethylene diamine, butylene diamine, N-aminoethyl trimethylene diamine, N-dodecyl propylene diamine, di-(trimethylene) triamine, pentaethylene hexamine, N-(2-hydroxyethyl) ethylene diamine, N-(3-hydroxybutyl tetramethylene diamine, etc. It includes also higher and cyclic homologues of such amines such as piperazines. The ethylene amines are especially useful. They are discussed in some detail under the heading "Ethylene Amines" in "Encyclopedia of Chemical Technology" Kirk and Othmer, Vol. 5, pages 898–905, Interscience Publishers, New York (1950). Such compounds are prepared most conveniently by the reaction of alkylene dihalide, e.g., ethylene dichloride, with ammonia or primary amines. This reaction results in the production of somewhat complex mixtures of alkylene amines including cyclic condensation products such as piperazine. These mixtures find use in the process of this invention. Heterocyclic polyamines also may be used, and specific examples include N-aminoethyl piperazine, N-2 and N-3 aminopropyl morpholine N-3-(dimethyl amine) propyl piperazine, 2-heptyl-3-(2-aminopropyl) imidazoline, 1,4-bis(2-aminoethyl) piperazine, 1-(2-hydroxyethyl) piperazine, and 2-heptadecyl-1-(2-hydroxyethyl)-imidazoline, etc.

Reactant (A-2) also may be one or more aliphatic polyamines containing at least one olefinic polymer chain having a molecular weight of from about 500 to about 10,000 attached to a nitrogen and/or to a carbon atom of an alkylene group containing and amino nitrogen atom. Preferred examples of such polyamines have the structural formula

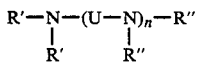

wherein R′ is selected from the group consisting of hydrogen and polyolefin having a molecular weight from about 500 to about 10,000, U is an alkylene radical having from 1 to 18 carbon atoms, preferably 1 to 4 carbon atoms, R″ is hydrogen or lower alkyl, with the proviso that at least one of R′ or R″ is hydrogen and at least one R′ is a polyolefin, and x is 1 to about 10. Preferred is when one R′ is a branched chain olefin polymer in the molecular weight range of 550 to 4900, and the other R′ is hydrogen. Preferably one R′ is hydrogen and one R′ is polypropylene or polyisobutylene with a molecular weight range of 600 to 1300.

The olefinic polymers (R′) which are reacted with polyamines include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-poly-alpha-methyl styrene groups and the corresponding groups without double bonds. Particularly preferred are polypropylene and polyisobutylene groups.

The R″ group may be hydrogen but is preferably lower alkyl, e.g., containing up to 7 carbon atoms and more preferably is selected from methyl, ethyl, propyl and butyl.

The polyamines reacted with the olefinic polymers include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to 18 carbon atoms. In the preparation of these compounds the same amines can be used such as: N-methyl ethylene diamine, N-propyl ethylene diamine, N,N-dimethyl 1,3-propane diamine, N-2-hydroxypropyl ethylene diamine, penta-(1-methylpropylene) hexamine, tetrabutylene-pentamine, hexa-(1,1-dimethylethylene) heptamine, di-(1-methylamylene) triamine, tetra-(1,3-dimethylpropylene) pentamine, penta-(1,5-dimethylamylene) hexamine, di(1-methyl-4-ethylbutylene) triamine, penta-(1,2-dimethyl-1-isopropylethylene) hexamine, tetraoctylenepentamine and the like.

Compounds possessing triamine as well as tetramine and pentamine groups are applicable for use because these can be prepared from technical mixtures of polyethylene polyamines, which offers economic advantages.

The polyamine from which the polyamine groups may have been derived may also be a cyclic polyamine, for instance, the cyclic polyamines formed when aliphatic polyamines with nitrogen atoms separated by ethylene groups were heated in the presence of hydrogen chloride.

An example of a suitable process for the preparation of the compounds employed according to the invention is the reaction of a halogenated hydrocarbon having at least one halogen atom as a substituent and a hydrocarbon chain as defined hereinbefore with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at an elevated temperature in the presence of a solvent; particularly a solvent having a boiling point of at least 160° C.

The reaction between a polyhydrocarbon halide and a polyamine having more than one nitrogen atom available for this reaction preferably is effected in such a way that cross-linking is reduced to a minimum, for instance, by applying an excess of polyamine.

The amine reactant (A-2) according to the invention may be prepared, for instance, by alkylation of low molecular weight aliphatic polyamines. For instance, a polyamine is reacted with an alkyl or alkenyl halide. The formation of the alkylated polyamine is accompanied by the formation of hydrogen halide, which is removed, for instance, as a salt of starting polyamine present in excess. With this reaction between alkyl or alkenyl halide and the strongly basic polyamines dehalogenation of the alkyl or alkenyl halide may occur as a side reaction, so that hydrocarbons are formed as byproducts. Their removal may, without objection be omitted.

Reactant A-2 also may be one or more alkanol amines characterized by the formula $$R(R)—N—R'—OH$$

wherein R' is a divalent hydrocarbyl group of 2 to about 18 carbon atoms, and each R is independently hydrogen, a hydrocarbyl group of 1 to about 8 carbon atoms or an amino- or hydroxy-substituted hydrocarbyl group of 2 to about 8 carbon atoms with the proviso that at least one R group is hydrogen or an amino-substituted hydrocarbyl group. Thus, the alkanol amines may be monoamines or polyamines. In a preferred embodiment, one R group is hydrogen and the other R group is an amino-substituted hydrocarbyl group.

Examples of such alkanol amines include N-(2-hydroxyethyl) ethylene diamine, N,N-bis(2-hydroxyethyl) ethylene diamine, 1-(2-hydroxyethyl) piperazine, monohydroxy-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino radicals or through hydroxy radicals are likewise useful as (a). Condensation through amino radicals results in a higher amine accompanied by removal of ammonia and condensation through the hydroxy radicals results in products containing ether linkages accompanied by removal of water.

REACTANT B

The second carboxylic acid acylating agent (B) utilized in the preparation of the dispersants for use in the fuel compositions of the present invention will depend upon the particular embodiment. In the "first embodiment", the second acylating agent may be any aliphatic monocarboxylic acid having at least 2 carbon atoms, or aromatic mono- and polycarboxylic acids or acid-producing compounds. In the "second embodiment", the second acylating agent may be an aromatic mono- or polycarboxylic acid or acid-producing compound containing at least 7 carbon atoms. Any of the aliphatic mono- and polycarboxylic acids identified as being useful as the first acylating agent may be utilized as the second acylating agent in the third embodiment. Also, any aromatic mono- and polycarboxylic acid or acid-producing compound identified earlier as being useful as a first acylating agent can be utilized as a second acylating agent in the first, second or third embodiments.

It is essential to the present invention, however, that the first carboxylic acylating agent and the second carboxylic acylating agent be selected to provide a total number of carbon atoms in the first and second acylating agents which is sufficient to render the dispersant hydrocarbon-soluble. Generally, the sum of the carbon atoms in the two acylating agents will be at least about 10 carbon atoms and more generally will be at least about 30 carbon atoms. Accordingly, if the first carboxylic acylating agent contains a large number of carbon atoms, the second carboxylic acylating agent does not need to contain a large number of carbon atoms, and may be, for example, a lower molecular weight of monocarboxylic acid such as hexanoic acid or a dicarboxylic acid such as succinic acid or succinic anhydride.

Preferably the second acylating agent in all three embodiments of the present invention is an aromatic mono- or polycarboxylic acid and more preferably is an aromatic polycarboxylic acid such as those identified earlier as examples of aromatic mono- and polycarboxylic acids useful as acylating agent (A-1). The most preferred second acylating agent used in the preparation of the dispersants are benzene dicarboxylic acids such as phthalic acid, isophthalic acid, terephthalic acid, and the various alkyl-substituted benzene dicarboxylic acids.

As mentioned earlier, although it is preferred that the dispersants useful in the fuel compositions of this invention be prepared by initially preparing a nitrogen-containing compound by reacting at least one first carboxylic acylating agent (A-1) with at least one alkylene polyamine (including alkanol amines), followed by the post-treatment of the nitrogen-containing composition with the second acylating agent (B), other sequences can be utilized. For example, the dispersants can be obtained by preparing a mixture of the first acylating agent and the second acylating agent and thereafter reacting the mixture with the polyamine. Another alternative method involves reacting the polyamine first with the second acylating agent and then with the first acylating agent, preferably at an elevated temperature.

The ratio of reactants utilized in the preparation of the dispersants may be varied over a wide range. Generally, the reaction mixture will contain, for each equivalent of the first acylating agent, at least about 0.5 equivalent of the polyamine, and from about 0.1 to about 1 equivalent or more of the second acylating agent (B) per equivalent of the polyamine (A-2). The upper limit of the polyamine reactant is about 2 moles per equivalent of the first acylating agent. The preferred amounts of the reactants are from about 1 to 2 equivalents of the polyamine and from about 0.1 to 2 equivalents of the second acylating agent for each equivalent of the first acylating agent.

The equivalent weight of the alkylene amine is based on the number of amino groups per molecule, and the equivalent weight of these acylating agents is based on the number of carboxy groups per molecule. To illustrate, ethylene diamine has 2 equivalents per mole, and tetraethylene pentamine has 5 equivalents per mole. The monocarboxylic acids have one carboxy group, and therefore the equivalent weight of the monocarboxylic acids is its molecular weight. The succinic and aromatic dicarboxylic acid acylating agents, on the other hand, have two carboxy groups per molecule, and therefore, the equivalent weight of each is one-half its molecular weight. In most cases, the equivalent weight of the polyamine is determined by its nitrogen content, and the equivalent weight of acylating agents is determined by their acidity or potential acidity as measured by the neutralization or saponification equivalents.

The precise composition of the dispersants utilized in the fuels of this invention is not known. It is believed, however, that the product is a complex mixture containing, for example, salts, amides, imides, or amidines formed by the reaction of the carboxy acid groups of the acylating agents with the nitrogen-containing groups of the polyamine. The composition of the dispersant may depend to some extent on the reaction conditions under which it is formed. Thus, a dispersant formed by the treatment of the acylated nitrogen intermediate (A) with an aromatic dicarboxylic acid at a temperature below about 100° C. may contain predominantly salt linkages whereas a product formed at a temperature above about 120° C. may contain predominantly amide, imide, or amidine linkages. It has been discovered, however, that such dispersants, irrespective of their precise composition, are useful for the purposes of this invention.

The temperature of the reaction used to prepare the dispersants useful in the fuels of this invention is not critical, and generally, any temperature from room temperature up to the decomposition temperature of any of the reactants or the product can be utilized. Preferably, however, the temperature will be above about 50° C. and more generally from about 100° C. to about 250° C.

When it is desired to prepare an initial nitrogen-containing composition (A) by reaction of the acylating agent (A-1) and the alkylene polyamine and/or alkanol amines (A-2), a mixture of one or more of the acylating agents and one or more of the polyamines is heated, optionally in the presence of a normally liquid, substantially inert organic liquid solvent/diluent. The reaction temperature will be, as defined above, generally above 50° C. up to the decomposition temperature of any of the reactants or of the product. The reaction of the acylating agent with the polyamines is accompanied by the formation of approximately one mole of water for each equivalent of the acid used. The removal of water formed may be effected conveniently by heating the product at a temperature above about 100° C., preferably in the neighborhood of about 150° C. Removal of the water may be facilitated by blowing the reaction mixture with an inert gas such as nitrogen during heating. It may likewise be facilitated by the use of a solvent which forms an azeotrope with water. Such solvents are exemplified by benzene, toluene, naphtha, n-hexane, xylene, etc. The use of such solvents permits the removal of water at a lower temperature, e.g., 80° C.

The reaction of the acylating agents (A-1) with the polyamines or alkanol amines (A-2) to form the initial nitrogen-containing composition (A) is conducted by methods well known in the art for preparing acylated amines, it is not believed necessary to unduly lengthen this specification by a further discussion of the reaction. Accordingly, U.S. Pat. Nos. 3,172,892; 3,219,666; 3,272,746; and 4,234,435 are expressly incorporated herein by reference for their disclosure with respect to the procedures applicable for reacting acylating agents with polyamines.

The following Examples 1-A to 16-A illustrate the initial preparation of the nitrogen-containing compositions (A) useful in this invention. These intermediate compositions also can be referred to as "acylated amines". Unless otherwise indicated in the following examples and elsewhere in the specification and claims, all parts and percentages are by weight, and temperatures are in degrees centigrade.

EXAMPLE 1-A

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7%.

EXAMPLE 2-A

To 1133 parts of commercial diethylene triamine heated at 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blown with nitrogen to remove volatiles. The mixture is held at 205°-230° C. for a total of 11.5 hours and then stripped at 230° C./20 torr to provide the desired acylated polyamine as a residue containing 6.2% nitrogen.

EXAMPLE 3-A

To 205 parts of commercial tetraethylene pentamine heated to about 75° C. there is added 1000 parts of isostearic acid while purging with nitrogen, and the temperature of the mixture is maintained at about 75°-110° C. The mixture then is heated to 220° C. and held at this temperature until the acid number of the mixture is less than 10. After cooling to about 150° C., the mixture is filtered, and the filtrate is the desired acylated polyamine having a nitrogen content of about 5.9%.

EXAMPLE 4-A

A mixture of 510 parts (0.28 mole) of polyisobutene (Mn=1845; Mw=5325) and 59 parts (0.59 mole) of maleic anhydride is heated to 110° C. This mixture is heated to 190° C. in seven hours during which 43 parts (0.6 mole) of gaseous chlorine is added beneath the surface. At 190°-192° C., an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the above substituted succinic acylating agent at 138° C. The reaction mixture is heated to 150° C. in two hours and stripped by blowing with nitrogen. The reaction mixture is filtered to yield the filtrate as an oil solution of the desired product.

EXAMPLE 5-A

An acylated nitrogen intermediate is obtained by mixing at 150° C., 242 parts (by weight) (5.9 equivalents) of a commercial polyethylene polyamine mixture having a nitrogen content of 34.2% and 1600 parts (2.9 equivalents) of a polyisobutene-substituted succinic anhydride having an acid number of 100 and prepared by the reaction of a chlorinated polyisobutene having a chlorine content of approximately 4.5% and a molecular weight of 1000 with 1.2 moles of maleic anhydride at 200° C. The product is diluted with mineral oil to form a 60% oil solution having a nitrogen content of 2.64%.

EXAMPLE 6-A

A mixture of 248 parts (by weight) of mineral oil, 37 parts of a commercial polyethylene polyamine mixture having a nitrogen content of 34% and 336 parts of the polyisobutene-substituted succinic anhydride of Example 1 is heated at 150° C. for one hour and blown with nitrogen at 150°-155° C. for 5 hours. The product is filtered and the filtrate has a nitrogen content of 2.06%.

EXAMPLE 7-A

A polyisobutenyl succinic anhydride is prepared by the reaction of a chlorinated polyisobutylene with maleic anhydride at 200° C. The polyisobutenyl radical has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction causes the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE 8-A

The procedure of Example 7-A is repeated except that the diethylene triamine is replaced on a nitrogen equivalent basis with ethylene diamine.

EXAMPLE 9-A

A substituted succinic anhydride is prepared by reacting maleic anhydride with a chlorinated copolymer of isobutylene and styrene. The copolymer consists of 94 parts by weight of isobutylene units and 6 parts by weight of styrene units, has an average molecular weight of 1200, and is chlorinated to a chlorine content of 2.8% by weight. The resulting substituted succinic anhydride has an acid number of 40. To 710 grams (0.15 equivalent) of this substituted succinic anhydride and 500 grams of toluene there is added portionwise 22 grams (0.51 equivalent) of hexaethylene heptamine. The mixture is heated at reflux temperature for three hours to remove by azeotropic distillation all of the water formed in the reaction, and then at 150° C./20 mm to remove the toluene.

EXAMPLE 10-A

A polyisobutylene having an average molecular weight of 50,000 is chlorinated to a chlorine content of 10% by weight. This chlorinated polyisobutylene is reacted with maleic anhydride to produce the corresponding polyisobutenyl succinic anhydride having an acid number of 24. To 6000 grams (2.55 equivalents) of this anhydride there is added portionwise at 70°-105° C., 108 grams (2.55 equivalents) of triethylene tetramine over a period of 45 minutes. The resulting mixture is heated for four hours at 160°-180° C. while nitrogen is bubbled throughout to remove the water. When all of the water has been removed, the product is filtered.

EXAMPLE 11-A

A polyisobutenyl-substituted succinic anhydride is prepared by the reaction of a chlorinated polyisobutene having a chlorine content of about 4.7% and a molecular weight of 1000 with about 1.2 moles of maleic anhydride. A mixture of 1647 parts (1.49 moles) of this polyisobutenyl substituted succinic anhydride and 1221 parts of mineral oil is prepared and heated to 75° C. with stirring whereupon 209 parts (2 moles) of aminoethylethanolamine are added with stirring. The mixture is blown with nitrogen and heated to about 180° C. The reaction mixture is maintained at this temperature with nitrogen blowing, and the water formed in the reaction is removed. The residue in the reaction vessel is the desired nitrogen-containing composition.

EXAMPLE 12-A

The procedure of Example 1-A is repeated except that the polyisobutene-substituted succinic anhydride is first converted to the corresponding succinic acid by treatment with steam at 150° C. and the succinic acid so produced is used in place of the anhydride in the reaction with the polyamine.

EXAMPLE 13-A

The procedure of Example 6-A is repeated except that the polyisobutene-substituted succinic anhydride is replaced on a chemical basis with the corresponding dimethyl ester of the anhydride prepared by esterifying the anhydride with two moles of the ethyl alcohol.

EXAMPLE 14-A

The procedure of Example 6-A is repeated except that the polyisobutene-substituted succinic anhydride is replaced on a chemical basis with the corresponding succinic dichloride prepared by hydrolyzing the anhydride with steam at 120° C. to form the corresponding acid and then treating the acid with phosphorus pentachloride.

EXAMPLE 15-A

A mixture of 3663 parts (3.3 moles) of a polyisobutenyl succinic anhydride prepared as in Example 11-A and 2442 parts of a diluent oil is prepared, stirred and heated to a temperature of 110° C. Aminoethylethanolamine (343 parts, 3.3 moles) is added over a period of 0.25 hour and the reaction temperature reaches 125° C. The mixture then is heated with nitrogen blowing to a temperature of about 205° C. over a period of 2 hours while removing water. The residue is the desired product containing 1.44% nitrogen.

EXAMPLE 16-A

A mixture of 4440 parts of the polyisobutenyl succinic anhydride prepared as in Example 11-A and 1903 parts of kerosene is prepared and heated to a temperature of 120° C. whereupon 416 parts (4 moles) of aminoethylethanolamine are added over a period of 0.4 hour. The mixture is then heated to about 200° C. in 1 hour under nitrogen and maintained at a temperature of about 200°-205° C. while removing water and some kerosene. The residue is the desired nitrogen-containing composition containing 1.68% nitrogen.

The following examples illustrate the preparation of the dispersants used in the fuel compositions of the invention.

EXAMPLE I

A mixture of 140 parts of a mineral oil, 174 parts of a polyisobutene (molecular weight 1000)-substituted succinic anhydride having an acid number of 105 and 23 parts of stearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. for one hour, cooled to 110° C. and filtered. The filtrate is found to contain 1.7% nitrogen and has an acid number of 4.5.

EXAMPLE II

A mixture of 528 grams (1 equivalent) of the polyisobutene-substituted succinic anhydride of Example I, 295 grams (1 equivalent) of a fatty acid derived from distillation of tall oil and having an acid number of 190, 200 grams of toluene and 85 grams (2 equivalents) of the polyalkylene polyamine mixture of Example I is heated at the reflux temperature while water is removed by azeotropic distillation. The toluene is removed by distillation and the mixture heated at 180°-190° C. for 2 hours, then to 150° C./20 mm. The residue is found to have a nitrogen content of 3.3% and an acid number of 9.8.

EXAMPLE III

A mixture of 33.2 grams (0.93 equivalent) of diethylene triamine, 100 grams (2.77 equivalents) of triethylene tetramine, 1000 grams (1.85 equivalents) of the polyisobutene substituted succinic anhydride of Example I and 500 grams of mineral oil is prepared at 100°-109° C. and heated at 160°-170° C. for one hour. The mixture is cooled and mixed with 266 grams (1.85 equivalents) of 2-ethyl hexanoic acid at 75°-80° C., and the resulting mixture is heated at 160°-165° C. for 12 hours. A total of 64 grams of water is removed as distillate. The residue is diluted with 390 grams of mineral oil, heated to 160° C. and filtered. The filtrate is found to have a nitrogen content of 2.3%.

EXAMPLE IV

To a mixture of 528 grams (1 equivalent) of the polyisobutene-substituted succinic anhydride of Example I, 30 grams (0.5 equivalent) of glacial acetic acid in 402 grams of mineral oil there is added 64 grams (1.5 equivalents) of the polyalkylene polyamine mixture of Example I at 70°-80° C. in one-quarter hour. The mixture is purged with nitrogen at 210°-220° C. for 3 hours and then heated to 210° C./50 mm. The residue is cooled and filtered at 70°-90° C. The filtrate is found to have a nitrogen content of 2% and an acid number of 2.

EXAMPLE V

A mixture of 1160 parts of the oil solution of Example 4-A, and 73 parts of terephthalic acid is heated at 150°-160° C. for about 4 hours and filtered. The filtrate is the desired product.

EXAMPLE VI

A mixture of 2852 parts of the product of Example 5-A and 199 parts (2.7 equivalents) of phthalic anhydride is heated at 150°-160° C. for 4 hours whereupon water is removed by distillation.

EXAMPLE VII

A mixture of the product of Example 6-A and 9.3 parts of terephthalic acid is heated at 155° C. for 0.5 hour and filtered. The filtrate is the desired product having a nitrogen content of 2.03%.

EXAMPLE VIII

A mixture of the product of Example 7-A and 0.1 equivalent (per equivalent of nitrogen in the product of 7-A) of 2-methyl benzene-1,3-dicarboxylic acid is heated at 135° C. for 3 hours while removing water.

EXAMPLE IX

A mixture of 2934 grams (5.55 equivalents based on the amine content) of the oil solution of the acylated nitrogen intermediate of Example 1-A and 230 grams (2.77 equivalents) of terephthalic acid is heated at 150°-160° C. until all of the water formed by the reaction is removed by distillation. The residue is heated at 160° C./5-6 mm and mixed with 141 grams of mineral oil and filtered. The filtrate is a 60% oil solution of the desired product having a nitrogen content of 2.47%.

EXAMPLE X

An acylated nitrogen intermediate is prepared as is described in Example 1-A except that the amount of the amine reactant used is 1.5 equivalents per equivalent of the anhydride reactant. A mixture of 738 grams (1.05 equivalents based on the amine present in the intermediate) of the intermediate and 11.2 grams (0.13 equivalent) of terephthalic acid is heated at 140°-150° C. for 2 hours and then filtered. The filtrate has a nitrogen content of 1.9%.

EXAMPLE XI

The procedure of Example X is repeated except that 5.6 grams (0.064 equivalent) of terephthalic acid is used in the reaction mixture. The product so obtained has a nitrogen content of 2%.

EXAMPLE XII

The procedure of Example X is repeated except that 1,6-naphthalene dicarboxylic acid (7.5 grams, 0.09 equivalent) is used in place of terephthalic acid and the amount of the acylated nitrogen intermediate used is 492 (0.725 equivalents). The product so obtained has a nitrogen content of 1.9%.

EXAMPLE XIII

An acylated nitrogen intermediate is prepared by the procedure of Example 1-A from 1.4 equivalents of the commercial polyethylene polyamine and 1 equivalent of the polyisobutene-substituted succinic anhydride. To 2000 grams of a 60% oil solution of the intermediate, there is added 74 grams of phthalic anhydride at room temperature. A slight exothermic reaction occurs. The reaction mixture is heated at 200°-210° C. for 10 hours whereupon water is distilled off. The residue is filtered and the filtrate has a nitrogen content of 1.84%.

EXAMPLE XIV

A mixture of 526 grams (1 equivalent) of the polyisobutene-substituted succinic anhydride of Example 1-A, 73 grams (1 equivalent) of phthalic anhydride and 300 grams of xylene is prepared at 60° C. To this mixture there is added at 60°-90° C., 84 grams (2 equivalents) of a commercial polyethylene polyamine mixture having a nitrogen content of 73.4% and an equivalent weight of 42. The mixture is heated at 140°-150° C. whereupon 18 grams of water is distilled off. The residue is mixed with 455 grams of mineral oil and heated to 150°/20 mm to distill off all volatile components and then is filtered. The filtrate is a 60% oil solution of the product having a nitrogen content of 2.35%.

EXAMPLE XV

The procedure of Example XIV is repeated except that the reaction mixture consists of 790 grams (1.5 equivalent) of the polyisobutene-substituted succinic anhydride, 36.5 grams (0.5 equivalent) of phthalic anhydride and 84 grams (2 equivalents) of the polyethylene polyamine. The product, a 60% oil solution of the nitrogen composition, has a nitrogen content of 1.27%.

EXAMPLE XVI

The procedure of Example VI is repeated except that the polyisobutene-substituted succinic anhydride is first converted to the corresponding succinic acid by treatment with steam at 150° C. and the succinic acid so produced is used in place of the anhydride in the reaction with the polyamine and phthalic anhydride.

EXAMPLE XVII

A substituted dimethylsuccinate is prepared by reacting one mole of a chlorinated petroleum oil having a molecular weight of 1200 and a chlorine content of 3% with 1.5 moles of dimethylmaleate at 250° C. A mixture of 2 equivalents of the above succinate, 10 equivalents tetrapropylene pentamine, and 1 equivalent of terephthalic acid is prepared at 25° C. and heated at 150°-180° C. for 6 hours whereupon all volatile components are distilled off and then filtered. The filtrate is the desired product.

EXAMPLE XVIII

N-octadecylpropylene diamine (1 equivalent) is heated with 0.5 equivalent of terephthalic acid at 100° C. for 1 hour. The above intermediate product is then heated at 150°-190° C. with 2 equivalents of a substituted succinic acid obtained by reacting at 120°-200° C. one mole of a chlorinated polypropylene having a molecular weight of 2500 and a chlorine content of 2.3% with 2 moles of maleic acid to form the desired product.

EXAMPLE XIX

The procedure of Example XVIII is repeated except that the substituted succinic acid is replaced on a chemical equivalent basis with the corresponding succinic acid monochloride.

EXAMPLE XX

To the product obtained in Example 11-A, there is added 124.5 parts of isophthalic acid in portions. The mixture is heated to 200° C. and maintained at this temperature until no more water can be removed. The mixture is filtered to give the desired product containing 1.7% nitrogen.

EXAMPLE XXI

The procedure of Example XX is repeated except that the isophthalic acid is replaced by an equivalent amount of phthalic anhydride.

EXAMPLE XXII

The procedure of Example XX is repeated except that the isophthalic acid is replaced by an equivalent amount of isostearic acid.

EXAMPLE XXIII

The procedure of Example XX is repeated except that the isophthalic acid is replaced by an equivalent amount of tetrapropenyl-substituted succinic acid.

EXAMPLE XXIV

The procedure of Example IX is repeated except that the substituted succinic anhydride is replaced by an equivalent amount of the acid prepared by reacting chlorinated polyisobutylene and acrylic acid in 1:1 equivalent ratio and having an average molecular weight of about 98%.

EXAMPLE XXV

Adipic acid (36.5 parts, 0.25 mole) is added to 965 parts (0.5 mole) of the acylated amine prepared in Example 15-A and the mixture is maintained at a temperature of about 120° C. The mixture then is heated under nitrogen to a temperature of about 200° C. in 0.5 hour and maintained at about 200°-210° C. under nitrogen for an additional 2 hours while collecting water. The reaction mixture is filtered and the filtrate is the desired product containing 1.41% nitrogen.

EXAMPLE XXVI

Terephthalic acid (62.2 parts, 0.375 mole) is added to 1448 parts (0.75 mole) of the oil solution of the acylated amine prepared in Example 15-A. The mixture is heated to a temperature of about 225° C. over a period of about 3 hours while collecting water. The temperature then is raised to 235° C. in one hour and maintained at 235°-240° C. for about 3 hours while collecting additional water. After cooling to about 210° C., a filtrate is added with stirring and the mixture is filtered. The filtrate is the desired product containing 1.41% nitrogen.

EXAMPLE XXVII

Phthalic anhydride (74 parts, 0.5 mole) is added to 1930 parts (1 mole) of the acylated amine prepared in Example 15-A at a temperature of 120° C. The mixture then is heated to 200° C. under nitrogen and maintained at a temperature of about 205°-210° C. for about 2 hours while removing water. The mixture is filtered and the filtrate is the desired product containing 1.45% nitrogen.

EXAMPLE XXVIII

The procedure of Example XXVII is repeated except that the phthalic anhydride is replaced by 83 parts (0.5 mole) of isophthalic acid. The product obtained in this manner contains 1.41% nitrogen.

EXAMPLE XXIX

To 1661 parts (1 mole) of the acylated amine prepared as in Example 15-B at a temperature of 120° C. there is added 83 parts (0.5 mole) of isophthalic acid. The mixture is heated under nitrogen to a temperature of about 200°-210° C. and maintained at this temperature for about 1 hour while collecting water. The mixture is filtered and the filtrate is the desired product containing 1.62% nitrogen.

The amount of the dispersant included in the fuel compositions of the present invention may vary over a wide range although it is preferred not to include unnecessarily large excesses of the dispersant. The amount included in the fuel should be an amount sufficient to improve the desired properties such as the prevention and/or reduction in the amount of deposits on the various parts of internal combustion engines such as in the intake systems and the fuel injector nozzles when the fuel in burned in internal combustion engines. The fuel may contain from about 1 to about 10,000, and preferably from about 5 to about 5000 parts by weight of the dispersant per million parts of the fuel, and more generally will contain from about 20 to about 2000 parts of the dispersant per one million parts by weight of the fuel. Accordingly, when the dispersants utilized in the fuel compositions of the present invention are described as being hydrocarbon-soluble, it is imperative that the dispersants be sufficiently soluble in the hydrocarbon fuels to provide the desired concentrations specified above.

The fuel compositions of the present invention can be prepared by adding the dispersants to a liquid hydrocarbon fuel, or a concentrate of the dispersant in a substantially inert, normally liquid organic solvent/diluent such as mineral oil, xylene, or a normally liquid fuel as described above can be prepared, and the concentrate added to the liquid hydrocarbon fuel. The concentrates generally contain about 10-90, usually 20-80% of the dispersant of the invention, and the concentrate can also contain any of the conventional additives for fuels such as those described below.

In addition to the dispersant of this invention, the use of other conventional fuel additives in the fuel compositions (and concentrates) of the present invention is contemplated. Thus, the fuels can contain anti-knock agents such as tetraalkyl lead compounds, lead scavengers such as halo alkanes (e.g., ethylene dichloride and ethylene dibromide), deposit preventors or modifiers such as trialkyl phosphates, dyes, anti-oxidants such as 2,6-ditertiary butyl-4-methyl phenol, rust-inhibitors, such as alkylated succinic acids and anhydrides, gum inhibitors, metal deactivators, demulsifiers, upper cylinder lubricants, anti-icing agents, etc.

We claim:

1. A fuel composition for an internal combustion engine, comprising:

a major amount of a liquid hydrocarbon fuel; and a minor amount of a hydrocarbon-soluble dispersant, the dispersant being present in an amount sufficient to reduce the formation of engine deposits, the dispersant being prepared by reacting (A-1) a first acylating agent selected from the group consisting of monocarboxylic acids, polycarboxylic acids and anhydrides thereof, the acylating agent having a substituent group containing an average of at least about 10 aliphatic carbon atoms, with (A-2) an alkanol amine; and (B) a second acylating agent in the form of an aromatic mono or polycarboxylic acid or anhydride, the total number of carbon atoms in the first and second acylating agents (A-1) and (B) being sufficient to render the dispersant hydrocarbon-soluble wherein the equivalent ratio of (A-1):(A-2):(B) is in the range of about 1:(0.5 to 2):(0.05 to 2).

2. A fuel composition as claimed in claim 1 wherein the first acylating agent (A-1) is an alphatic mono-carboxylic acid.

3. A fuel composition as claimed in claim 1 wherein the first acylating agent (A-1) is an alphatic polycarboxylic acid or anhydride.

4. A fuel composition as claimed in claim 1 wherein the first acylating agent (A-1) is a hydrocarbon-substituted succinic acid or succinic anhydride.

5. A fuel composition as claimed in claim 1 wherein the alkanol amine (A-2) has the following structural formula:

$$R(R)—N—R'—OH$$

wherein R' is a divalent hydrocarbyl group containing 2 to about 18 carbon atoms, and each R is independently selected from the group consisting of hydrogen, a hydrocarbyl group containing 1 to about 8 carbon atoms and an amino- or hydroxy-substituted hydrocarbyl group containing 2 to about 8 carbon atoms with the proviso that at least one R group is hydrogen or an amino-substituted hydrocarbyl group.

6. A fuel composition as claimed in claim 5 wherein one R group is hydrogen and the other R group is an amino-substituted hydrocarbyl group.

7. A fuel composition as claimed in claim 5 wherein (A-2) is aminoethylethanolamine.

8. A fuel composition as claimed in claim 1 wherein the aromatic polycarboxylic acid or anhydride is an aromatic dicarboxylic acid or anhydride.

9. A fuel composition as claimed in claim 8 wherein the aromatic dicarboxylic acid is a benzene dicarboxylic acid.

10. A fuel composition as claimed in claim 9 wherein the benzene dicarboxylic acid is isophthalic acid or terephthalic acid.

11. A fuel composition as claimed in claim 5 wherein the hydrocarbon-soluble dispersant is present in the fuel composition in an amount in the range of about 5 to about 5,000 parts by weight per million parts by weight of the fuel.

12. A process for reducing deposits in an internal combustion engine, comprising the steps of:

adding to a major amount of a liquid hydrocarbon fuel a minor amount of a hydrocarbon-soluble dispersant, the dispersant being added in an amount sufficient to reduce the formation of engine deposits, the dispersant being prepared by reacting (A-1) a first acylating agent selected from the group consisting of monocarboxylic acids, polycarboxylic acids and anhydrides thereof, the acylating agent having a substituent group containing an average of at least about 10 aliphatic carbon atoms, with (A-2) an alkanol amine; and (B) a second acylating agent in the form of an aromatic mono or polycarboxylic acid or anhydride the total number of carbon atoms in the first and second acylating agents (A-1) and (B) being sufficient to render the dispersant hydrocarbon-soluble wherein the equivalent ratio of (A-1):(A-2):(B) is in the range of about 1:(0.5 to 2):(0.05 to 2); and using the fuel composition in an internal combustion engine.

13. The process as claimed in claim 12 wherein the first acylating agent (A-1) is an aliphatic mono-carboxylic acid.

14. The process as claimed in claim 12 wherein the first acylating agent (A-1) is an aliphatic polycarboxylic acid or anhydride.

15. The process as claimed in claim 12 wherein the first acylating agent (A-1) is a hydrocarbon-substituted succinic acid or succinic anhydride.

16. The process as claimed in claim 12 wherein the alkanol amine (A-2) has the following structural formula:

$$R(R)—N—R'—OH$$

wherein R′ is a divalent hydrocarbyl group containing 2 to about 18 carbon atoms, and each R is independently selected from the group consisting of hydrogen, a hydrocarbyl group containing 1 to about 8 carbon atoms and an amino- or hydroxy-substituted hydrocarbyl group containing 2 to about 8 carbon atoms with the proviso that at least one R group is hydrogen or amino-substituted hydrocarbyl group.

17. The process as claimed in claim 16 wherein one R group is hydrogen and the other R group is an amino-substituted hydrocarbyl group.

18. The process as claimed in claim 16 wherein (A-2) is aminoethylethanolamine.

19. The process as claimed in claim 12 wherein the aromatic polycarboxylic acid or anhydride is an aromatic dicarboxylic acid or anhydride.

20. The process as claimed in claim 19 wherein the aromatic dicarboxylic acid is a benzene dicarboxylic acid.

21. The process as claimed in claim 20 wherein the benzene dicarboxylic acid is isophthalic acid or terephthalic acid.

22. The process as claimed in claim 16 wherein the hydrocarbon-soluble dispersant is added to the fuel composition in an amount in the range of about 5 to about 5,000 parts by weight per million parts by weight of the fuel.

* * * * *